United States Patent [19]

Boy-Marcotte et al.

[11] Patent Number: 4,511,805

[45] Date of Patent: Apr. 16, 1985

[54] CONVERTOR FOR THERMAL ENERGY INTO ELECTRICAL ENERGY USING STIRLING MOTOR AND INTEGRAL ELECTRICAL GENERATOR

[75] Inventors: Jean-Louis Boy-Marcotte, Orsay; Gilbert M. I. Dahan, Paris; Michel Dancette, Vaucresson; Marcel P. Le Nabour, Limonest; Jean-François G. A. Pellerin, Boulogne; José Rivallin, Plaisir; Marcel A. J. Jannot, Sarcelles, all of France

[73] Assignee: BERTIN & Cie, Plaisir, France

[21] Appl. No.: 400,064

[22] Filed: Jul. 20, 1982

[30] Foreign Application Priority Data

Jul. 21, 1981 [FR] France ..... 81 14185

[51] Int. Cl.[3] ..... F02G 1/045

[52] U.S. Cl. ..... 290/2; 290/1 R; 60/518; 60/519; 60/525

[58] Field of Search ..... 290/1 R, 2; 60/517–519, 525; 123/46 E

[56] References Cited

U.S. PATENT DOCUMENTS 3,675,031 7/1972 Lavigne ..... 290/1
3,802,196 4/1974 Franklin ..... 60/519
4,404,802 9/1983 Beale ..... 60/517
4,418,533 12/1983 Folsom ..... 60/517

FOREIGN PATENT DOCUMENTS 862487 2/1971 Canada ..... 60/518
1547768 6/1979 United Kingdom ..... 60/525

*Primary Examiner*—Stanley J. Witkowski
*Assistant Examiner*—Shelley Wade
*Attorney, Agent, or Firm*—A. W. Breiner

[57] ABSTRACT

The present invention relates to external combustion engines and more precisely to motors using the Stirling cycle designed to directly convert thermal energy into electrical energy.

In accordance with the invention, this transformation is carried out inside a machine which is completely sealed, without a mechanical connection with the outside, in which the power piston drives the moveable part of an electrical generator. In accordance with one preferred embodiment, this electrical generator is a linear alternator. In accordance with a further original feature of the invention, control of the coupling between the displacing piston and the power piston is carried out by using electronic regulation.

13 Claims, 2 Drawing Figures

CONVERTOR FOR THERMAL ENERGY INTO ELECTRICAL ENERGY USING STIRLING MOTOR AND INTEGRAL ELECTRICAL GENERATOR

The present invention relates to a convertor for thermal energy into electrical energy employing the Stirling cycle along with an integral electrical generator.

The original design provided makes it possible to envisage development on an industrial scale of the Stirling motor, the principle of which has been known for many years, but which, up until now, has been delayed for two essential reasons.

The first of these is of an economic nature: the internal combustion engine, bearing in mind the mode-rate cost of gasoline until fairly recently, associated with limited concern as regards pollution, resulted in more expensive external combustion engines being left in the shade as they require the use of sophisticated heat exchangers. These arguments are becoming increasingly less valid as the cost of gasolene continues to rise.

The second of these is of a technical nature: the problems of dry friction have hindered the development of sealed engines and, secondly, engines using a connecting rod and crankshaft system present a difficult sealing problem at the position where the shaft passes through between the enclosure inflated with helium or with air, at a pressure of several tens of bars, and the outside.

In order to make the improvements provided by the present invention more clear, we shall now briefly recall the operation of such a machine.

A Stirling engine makes use of an association of a thermocompressor and one or several power pistons responsible for transforming the variation in pressure produced by the thermocompressor into an alternating motion.

In order to facilitate understanding of the operation of this machine, reference will be made to FIG. 1 in which the thermocompressor is provided by the circuit 1, comprising in series: a cold heat exchanger 4, a regenerator 3, and a hot heat exchanger 2, linked in a closed circuit arrangement to a cylinder in which a displacing piston 7 moves.

The alternating movements of the displacing piston 7 simply have the effect of transferring the working fluid, which is helium or air under a pressure of several tens of bars, from one chamber of the cylinder into the other whilst passing through the heat exchangers of circuit 1. The result of this is that the working fluid alternately undergoes successive heating and cooling operations depending on the direction of travel through the circuit 1, indicated by the arrows 1*a* and 1*b*. These successive and alternating thermal transformations, under constant volume conditions, bring about variations in pressure which give rise to the name thermocompressor. In general, these variations in pressure are transmitted to a mechanical system which is external of the enclosure in which the displacing piston moves, using any desired type of mechanical linkage such as a connecting rod and crankshaft system. It is this linkage which presents the problem of sealing at the position where the shaft passes out from the enclosure under pressure to the outside.

The present invention overcomes the sealing problem mentioned above by providing a unit which is completely sealed without using a mechanical linkage with the outside, inside of which the pressure variations induced by the movement of the displacing piston are directly applied to the face of one or several drive or power pistons; the displacing piston is now completely without mechanical connection to the drive piston(s).

In order to achieve this, the mechanical power supplied by the drive piston is directly transformed, inside one and the same sealed enclosure, into electrical power via the intermediary of a convertor for converting mechanical energy into electrical energy.

In accordance with a first embodiment, this convertor is provided in the form of a conventional electrical generator such as a rotating electrical alternator the rotor of which would be connected to the power or drive piston, by, for example, a connecting rod and crankshaft system.

In accordance with a second preferred embodiment, this convertor takes the form of a linear electrical generator, the moving magnet of which is rigidly fixed to the power or drive piston which is directly subject to the pressure variations induced by the motion of the displacing piston.

In accordance with one particular preferred arrangement of this second embodiment, this linear electrical generator is a linear alternator.

The coupled oscillations of the displacing and drive pistons are, in this case, maintained by a periodic force, using imposed pulsing, applied to the displacing piston.

In accordance with one general embodiment of the unit, the movements of the drive and displacing pistons are colinear inside one and the same cylindrical cavity. In this case, the drive to the displacing piston is advantageously provided using a linear electrical motor the moveable magnetic pole piece of which is rigidly fixed to the displacing piston.

This arrangement makes it possible to eliminate the non-symmetrical forces present in conventional drive systems such as the connecting rod and crankshaft system which gives rise to significant mechanical losses and sources of vibration: here, the moveable components only oppose forces which are colinear with their displacements.

Thus, the moveable parts of the displacing system and the drive system require no lubrication (dry friction).

Using a conventional arrangement, the moveable assembly of the linear motor constitutes a resonating system having its own determined frequency. Thus, the pulsating action imposed on the displacing piston by the frequency of the supply current from the linear motor, which may be variable, will be selected so as, preferably, to be close to the natural frequency of the resonating system in order to provide optimum operation.

As the two pistons are performing a harmonic motion at constant frequency, the resultant of these movements is also a harmonic movement at the same frequency. Under these conditions, the combined mechanical vibrations of the unit, inside of which these movements operate, readily lends itself to very simple balancing using conventional passive vibration dampers.

In accordance with a second general embodiment of the unit, the movements of the displacing and drive pistons take place in two separate cavities which are in communication with each other via at least one conduit or channel offering a minimum pressure loss.

In this embodiment, the variations in pressure induced by the motion of the displacing piston are applied to the face of at least one drive piston.

In the case where there are several drive pistons, the latter are advantageously present in an even number and consequently operate using opposing couples. One arrangement which is preferred because of the simplicity of its design is provided by the combination of two drive pistons caused to perform opposing movements in the same cylindrical cavity, starting from an equilibrium position at which the faces of the two pistons, which face each other, determine a chamber in the region of the center of which the conduit or conduits which transmit the pressure variations induced by the motion of the displacing piston discharge. This arrangement moreover has the advantage of providing a unit which is perfectly balanced.

In accordance with this arrangement, the drive pistons constitute resonant mechanical systems having a determined natural frequency of longitudinal oscillation (50 HZ, for example).

In accordance with a first embodiment, the actual working fluid is used to constitute a pneumatic spring, the dimensions of the machine being designed in such a fashion that the working fluid occupies an effective volume having a certain elasticity which corresponds to a certain natural frequency of the drive piston, which it is desired to establish.

In accordance with a second embodiment, the rods of said pistons are connected to the fixed structure of the cavity by an elastic linkage such as a mechanical, hydraulic or other type of spring. For a given amplitude of movement of the drive pistons, the power received at the terminals of the linear alternator is a maximum when the frequency of oscillation of the displacing piston is equal to the natural frequency of said drive pistons. This resonant frequency will advantageously be substantially close to the natural frequency of longitudinal oscillation of the moveable components of the linear motor. These natural frequencies are advantageously adjustable, using mechanical means which make it possible to modify, from a position externally of the enclosure, the stiffness of these resonant mechanical systems, using a conventional stretching system in the case of a mechanical linkage using a spring, or by modifying the volume occupied by the working fluid. In accordance with this second embodiment, the drive to the displacing piston can be equally as well obtained using a linear or a rotating electric motor.

In conventional Stirling motors, the coupling between the drive piston and the displacing piston is generally provided using mechanical or pneumatic means, so that the de-phasing between the movements of the two pistons is set up once and for all at the time of design of the machine. Generally, the initial de-phasing provided is such that the movements of the two pistons are in quadrature, the movement of the displacing piston then being in advance in phase, in the case where it is desired to transmit a maximum power. Moreover, this type of linkage providing the coupling between the two pistons may deteriorate with the passage of time so that the motor is no longer set, after a certain number of hours of running, to the point of optimal operation for which it was designed. Adjustment can then only be carried out by direct intervention performed on the machine.

On the other hand, in accordance with one important further characteristic of the invention, the device claimed makes it possible to adapt the operation of the machine in response to variable constraints on utilisation, such as a variable thermal power at the heat source, or a variable electrical loading, or where optimum yield is required. In effect, it makes it possible to regulate the coupling between the displacing piston and the drive pistons using both mechanical means which are accessible from outside the unit and an electronic regulating system.

The regulation of the physical parameters of the aeromechanical coupling between the two sets of pistons is provided using mechanical means, such as those which allow regulation of the stiffness of the mechanical linkage between the various moveable assemblies as discussed above, or regulation of the volume of the expansion chamber by putting the latter in communication with an additional volume via a shut-off valve.

A further important advantage of the invention is represented by the electronic regulation system which is made possible by the nature of the electro-mechanical linkage with can be established between the mechanical variables which characterize the movements of the two sets of pistons and the electrical variables which characterize the electrical values present at the input to and the output from the electro-mechanical system.

Thus, the de-phasing between the movements of the two pistons will be subject to control, notably by providing phase regulation between the instantaneous electrical voltages at the input and the output of the electro-mechanical system.

This regulation may, in particular, be arranged to operate on two fundamental kinematic variables of the motion of the coupled mechanical system: these being the frequency and the de-phasing between the movements of the displacing and drive pistons Concerning regulation of the frequency, the dephasing then being imposed, this can be carried out either using a conventional regulator for the speed of rotation of the motor driving the displacing piston, using for example an electronic speed varying means, or can be done by chopping the feed current to the linear motor using a conventional "chopper".

The sweeping of this frequency makes it possible, notably, to provide tuning to the aeromechanic resonant frequency of the drive piston for which the power supplied is at a maximum.

Control of the de-phasing is carried out by varying the phase of the current and, notably, the supply voltage to the drive motor with respect to the current supplied by the linear alternator using a conventional system of phase regulation.

It is consequently possible to distinguish two types of regulation, depending on whether these operate:

using a constant level of thermal power available from the source of heat, the regulating system then operating using the processes indicated above so as to ensure that the Stirling motor delivers an electrical output which corresponds to the demands of the moment, at a constant level of electrical power supplied, the regulating system then controlling the amount of thermal power supplied by the heat source, which corresponds to the optimum output from the machine, by, for example, varying the rate at which the fuel is supplied.

In the two types of regulation described above, one can, when drive by a linear motor is involved, all other things moreover being equal, control the amplitude of the movement of the displacing piston by simultaneously or separately varying the value of the supply voltage to the linear motor, using, for example, a voltage transformer, and/or by varying the cyclic ratio or the pulse width by employing a conventional system known as a "chopper".

In each case, the supply to the drive motor can be provided equally as well either from the current produced by the generator or from an independent source of electrical energy. This flexibility of use, in association with the potential advantages of a motor using the Stirling cycle such as:

a thermal/electrical yield in the range of from 30 to 40% at power levels of the order of some tens of kilowatts or of one megawatt, the specific characteristics of external combustion:

the ability to use a wide variety of fuels (oils, coal, gases of low calorific value, solar energy)

pollution controlled at the location of the burner, low noise level, makes it possible to immediately envisage its application in the following fields:

electrical generators used at remote sites: the ability to use a range of fuels associated with a good yield now enables it to rival the diesel engine, heating of dwellings via the intermediary of a heat pump driven by a Stirling motor operating under total energy conditions, thanks to and particularly because of:

the low level of noise and vibrations (rectilinear movements)

the reduced level of maintenance which the burner requires.

These characteristics and other which have not been mentioned will become clear from the description which follows.

In order to establish the object of the invention without however limiting it, in the attached drawings.

Figure 1:
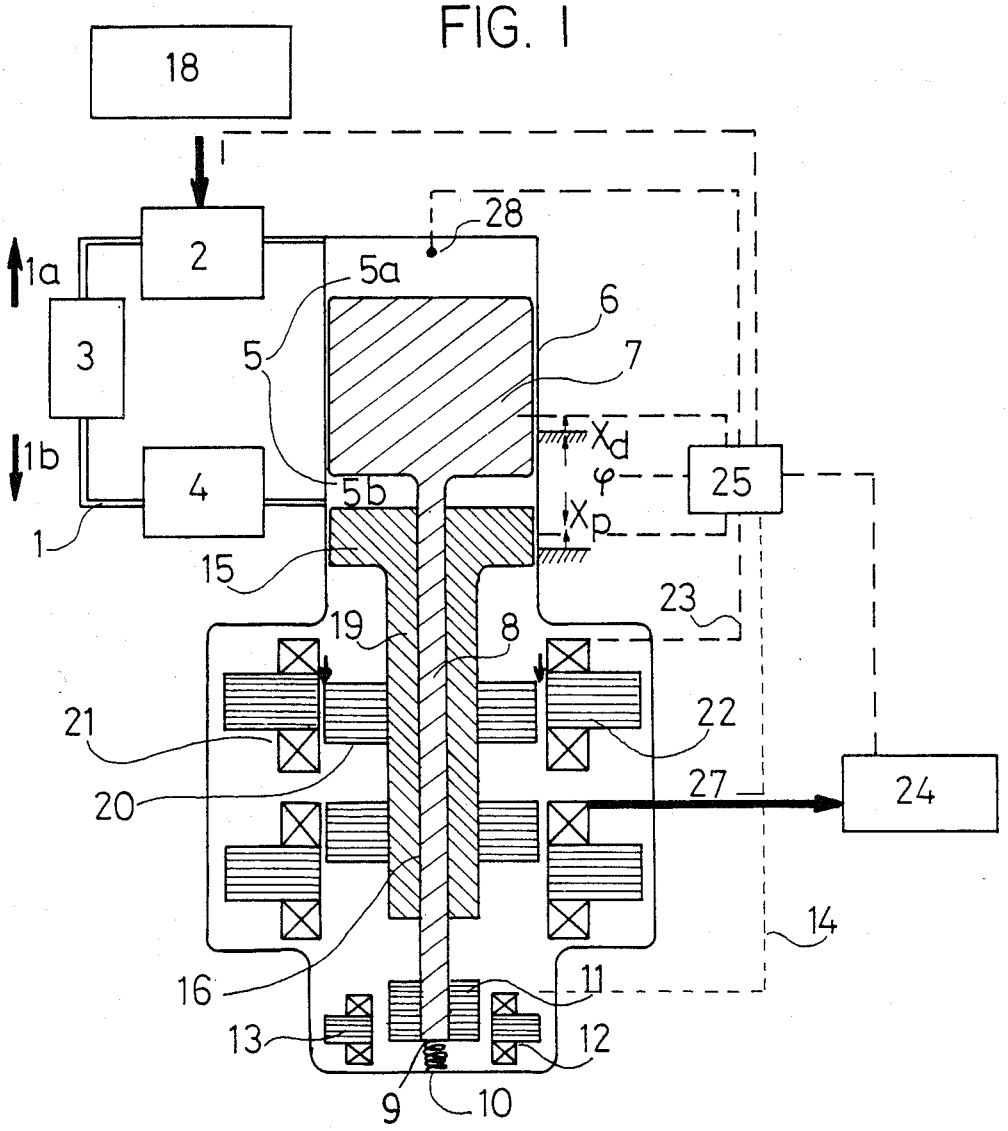
FIG. 1 is an axial section of one preferred embodiment.

The essential components constituting the machine using the Stirling cycle with an integral electrical generator, constituting the object of the invention, are illustrated particularly in FIG. 1 where, diagrammatically, a circuit 1 will be seen comprising successively: a hot heat exchanger 2, a regenerator 3 and a cold heat exchanger 4 in which the working fluid circulates, which for example is helium or air under pressure, which undergoes successive heating and cooling operations depending on the direction of travel through said circuit 1, indicated by arrows 1*a* and 1*b*.

This circuit 1 communicates with the two chambers 5*a* and 5*b* of the cavity 5, of a cylindrical enclosure 6, defined by the path of travel of the displacing piston 7 within said enclosure 6; the portion 5*a* which is directly associated with the hot heat exchanger 2 is referred to as the hot portion, and the portion 5*b* which is directly associated with the cold heat exchanger 4 is referred to as the cold portion.

The rod 8 of the displacing piston 7 is connected to the cylinder wall 6 at its end 9 using a resilient system 10; this resilient connection could be situated at the opposite end and fixed onto the actual body of piston 7, but, in this case, it would be subject to thermal variations which would periodically modify its mechanical characteristics.

The end portion of the rod 8 carries the magnetic armature 11 of a linear electrical motor 12 the fixed part 13 of which is rigidly fixed to the enclosure wall 6 by connections which are not shown. The dashed line 14 symbolises the supply to the linear electrical motor 12.

Only a small amount of mechanical work is necessary to maintain the movement of the displacing piston 7 since it only needs to overcome the pressure losses involved in transferring working fluid through the heat exchangers, these being of the order of about one bar. This work will be supplied with a minimum loss if the frequency of the supply current to the linear motor is substantially equal to the natural frequency of the linear oscillator constituted by the mechanical system: this being constituted by the displacing piston 7, its rod 8, and the resilient connection 10.

In this embodiment, the movements of the displacing piston 7 and of the drive or power piston 15 are colinear within the same cylindrical enclosure 6, in which the sealing between the pistons 7 and 15 and the passage in the common cylinder 6 is obtained using a system of conventional seals or rings, which are not shown.

In this embodiment, the drive piston 15 has a central recess 16 inside of which the rod 8 of the displacing piston 7 is free to move.

The rod 19 of the drive piston 15 carries the moveable magnetic circuit 20 of the linear alternator 21.

The current supplied by the linear generator, in general, or the linear alternator 21 in particular shown by the arrow 21, is received at the terminals of the windings 22 which are supplied, over a fraction of the period of the current thus produced, by an excitation current shown symbolically by the dashed line 22, supplied, for example, by a buffer battery.

These windings 22 are advantageously made up by two coupled portions for recovering the electrical energy in the two directions of displacement of the motion of the drive piston 15 and for balancing the forces on the moveable parts; they define, together with the moveable parts 20, a reduced air gap of the order of several tenths of a mm. Control of the excitation current 23 will be obtained using power components such as thyristors.

The useful current will be available over a time interval during which the drive piston 15 is moving; it will advantageously be employed for charging a battery.

In accordance with an alternative embodiment, the moveable magnetic circuit is made up by a permanent magnet.

The supply current to the linear motor 12 will be taken, either directly from the current produced by the alternator 21, after previously putting it in a suitable form, or supplied via a battery which is charged by said alternator 21.

The electronic regulating system symbolically shown at 25 makes it possible to control the various operating parameters of the Stirling motor using the processes described in detail above, using the command instructions and the control signals symbolically shown in dashed lines which terminate at the system 25.

In particular, control of the de-phasing between the relative movements of the displacing piston 7 and the drive piston 15 is here shown symbolically by dashed lines originating from their respective positions $X_D$ and $X_p$, these positions being with respect to their equilibrium position.

The command instructions for the heat source 18 originate either prior to the burner by indicating the value for the rate of supply of the fuel which will advantageously be controlled by a solenoid valve or after the burner using an indication of the thermodynamic variables of the working fluid such as the temperature, for example, the value of which will be supplied by a sensor 28 located in the wall of the cavity 5*a*.

Regulation of the level of heat supplied by the heat source 18 depending on the requirements of the energy consumer shown symbolically at 24, is here obtained using an electronic system 25 which, for example, modulates the rate of fuel supplied by controlling the solenoid valve whilst at the same time adapting the machine to its optimum operating point.

Figure 2:
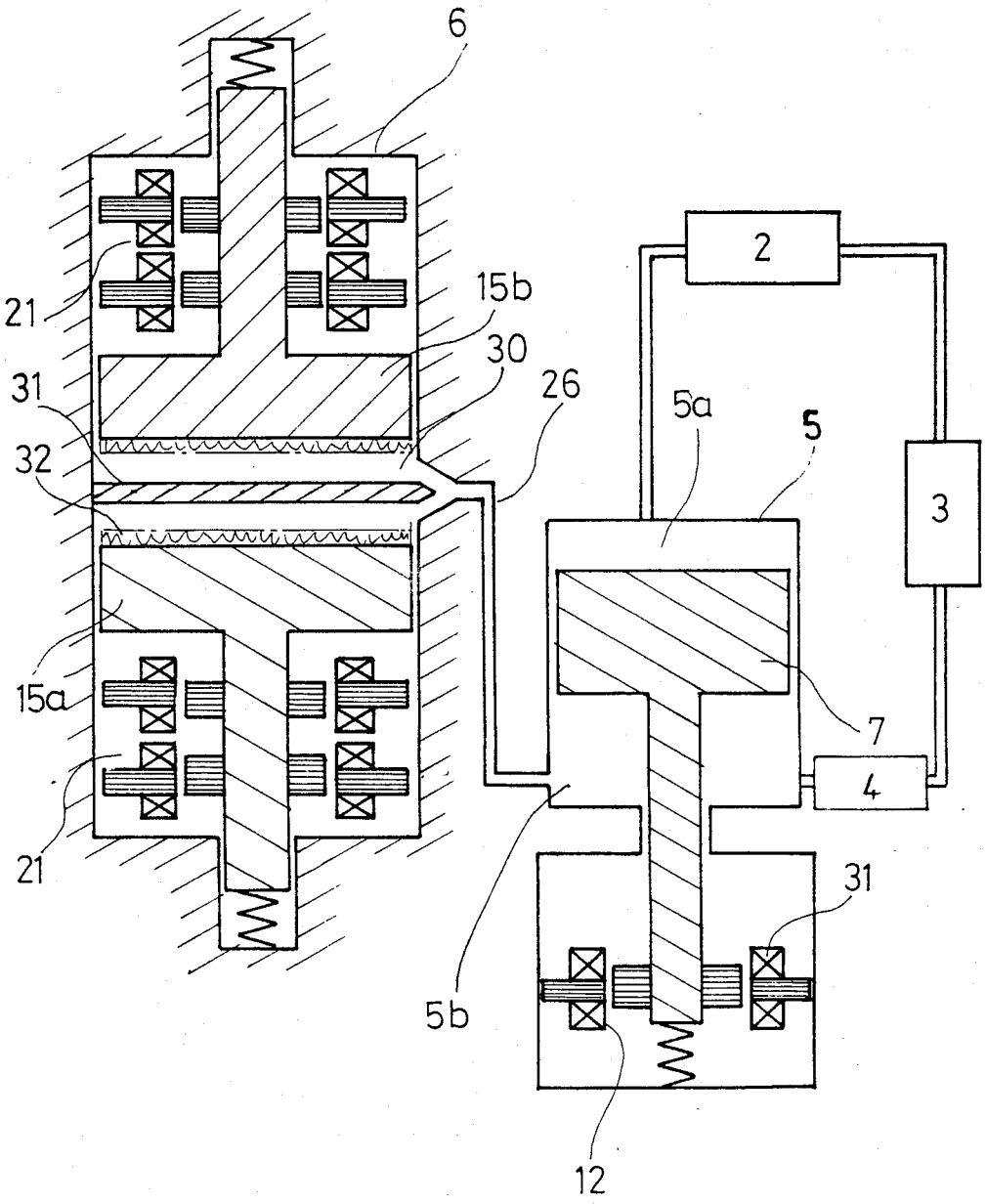
FIG. 2 is a diagrammatical axial section of a further embodiment.

In the embodiment shown in FIG. 2, the movements of the displacing piston 7 and the drive piston 15 take place in two separate cavities 5 and 6 which communicate with each other by means of least one conduit 26 which offers a minimum pressure loss and which connects the cold portion **5*b* of the cavity 5 to the chamber 30 of the cavity 6**.

In the case which is shown, the electrical power is supplied by two linear generators the drive pistons **15*a* and 15*b* of which operate in opposition; it would not lead to a departure from the scope of the invention if the electric power were to be supplied by a plurality of linear alternators operating pairwise or by one single alternator. In the same way, if the drive to the displacing piston 7 is provided, in the case shown, by a linear motor 12, one would not depart from the scope of the present invention if this were produced by a rotating electrical motor located inside the cavity 5**.

In a first variant, the faces which face each other of the two drive pistons are covered by a damping material 32.

In a second variant, this chamber 30 is divided into two symmetrical parts by a partition 31, constituted by a damping material which has the purpose of preventing mechanical contact of the two faces of the drive pistons. Each cavity thus formed is then connected to the cold portion 56 of the cavity **6*a* by a conduit 26** which equally distributes the flow into each one of said cavities.

This arrangement makes it possible to remove the problems of sealing and friction posed by the sliding of the rod 8 of the displacing piston 7 in the central recess of the drive piston 15. The advantage of the single cylinder is that it does not present any dead volume: the two pistons 7 and 8 may, at the limit, come into contact with each other.

Solely by way of indication, a guiding means for the movement of the drive pistons is shown diagrammatically at 33 in FIG. 2.

The machine in accordance with the invention is structured in such a way that the components constituting the motor and the electrical generators are located as far away as possible from the heat source 18.

In the two embodiments shown in FIGS. 1 and 2, the cylinder (or cylinders) 6, the circuit 1 including the heat exchangers are integrated into a sealed enclosure where the working fluid is, in the resting state, under a pressure of several tens of bars, 40 for example.

We claim:

1. Convertor for converting into electrical energy the mechanical energy developed by a thermal piston motor operating along the Stirling thermodynamic cycle, comprising a hermetically sealed enclosure under pressure deprived of mechanical connection to the outside, said hermetically sealed enclosure enclosing a displacing piston guided thereby to induce therein pressure variations due to piston movements, a drive piston also guided thereby and having a face on which said pressure variations are directly exerted without recourse to physical transmission between said pistons, a linear electric generator having a movable magnetic component, and a positive mechanical transmission between said drive piston and said movable magnetic component whereby said magnetic component positively follows up said drive piston and in return any electric control affecting said magnetic component inherently reflects fully on said drive piston for achieving an overall control of the magnetic component and drive piston assembly.

2. Convertor in accordance with claim 1, wherein said drive piston, said movable magnetic component and said positive mechanical transmission are integral with each other and form together a single-piece assembly which is bodily movable in said enclosure.

3. Convertor in accordance with claim 1, wherein said hermetically sealed enclosure comprises separate and distinct chambers for housing said displacing piston and said drive piston respectively, and duct means interconnecting said chambers.

4. Convertor in accordance with claim 1, characterized in that it includes two drive pistons driven with opposing alternating movements in the same cylindrical cavity, starting from an equilibrium position at which the faces of the two facing pistons determine a chamber which is in communication with the cold portion of the cylindrical cavity in which the displacing piston moves via the intermediary of at least one channel offering minimal pressure loss.

5. Convertor in accordance with claim 4, characterized in that the faces which face each other of the two pistons are coated with a damping material.

6. Convertor in accordance with claim 4, characterized in that said chamber defined by the facing faces of the two pistons is separated into two symmetrical parts by a partition constituted by a damping material, each one of said parts communicating with the cold portion of the cavity in which the displacing piston is moving via a conduit which equally distributes the flow into each one thereof.

7. Convertor in accordance with claim 4, characterized in that the alternating movement of the displacing piston is maintained by a rotating electric motor incorporated inside said cavity.

8. Convertor in accordance with claim 1, characterized in that the alternating movement of the displacing piston is maintained by a linear electric motor the moving magnetic component of which is connected to said displacing piston and of which the supply current is taken either from the current supplied by the electrical generator after putting it in a suitable form, or from an independent source of electrical energy.

9. Convertor in accordance with claim 8, characterized in that the movements of the displacing and drive pistons are colinear inside the same cylindrical cavity, the rods of said pistons being coaxial: the rod connected to the displacing piston sliding freely inside a central recess formed in the body of the drive piston.

10. Convertor in accordance with claim 8, characterized in that the coupling parameters between the displacing and drive pistons which determine the frequency of motion of the two pistons and their de-phasing are controlled by an electronic regulating system for the electrical values characteristic of the supply current and the output current from the electromechanical system, so that it is possible to adapt operation of the machine to variable operating restrictions.

11. Convertor in accordance with claim 10, characterized in that as the frequency of motion of the coupled mechanical system is imposed by the system, the dephasing between the motion of the two pistons is provided by a conventional phase control system operating between two electrical values which are characteristic of the supply current and the output current from the electromechanical system, such as the instantaneous voltage.

12. Convertor in accordance with claim 10, characterized in that, as the de-phasing between the motion of the pistons is imposed by the system, the frequency of motion of the coupled mechanical system is controlled by the frequency of the supply voltage to the drive motor.

13. Convertor in accordance with claim 8, characterized in that the amplitude of motion of the drive piston is controlled either using variation in the amplitude of the supply voltage to the linear motor or using a conventional electronic system known as a "chopper" which modifies the cyclic relationship of the pulses of said voltage.

* * * * *